US010563369B2

(12) United States Patent
Evirgen et al.

(10) Patent No.: US 10,563,369 B2
(45) Date of Patent: Feb. 18, 2020

(54) HIGH STRENGTH JET ANCHOR

(71) Applicant: ANADOLU UNIVERSITESI REKTORLUGU, Eskisehir (TR)

(72) Inventors: Burak Evirgen, Eskisehir (TR); Mustafa Tuncan, Eskisehir (TR); Ahmet Tuncan, Eskisehir (TR)

(73) Assignee: ANADOLU UNIVERSITESI REKTORLUGU, Eskişehir (TR)

( * ) Notice: Subject to any disclaimer, the term of this patent is extended or adjusted under 35 U.S.C. 154(b) by 0 days.

(21) Appl. No.: 16/099,405

(22) PCT Filed: Dec. 1, 2017

(86) PCT No.: PCT/TR2017/050619

§ 371 (c)(1),
(2) Date: Nov. 6, 2018

(87) PCT Pub. No.: WO2018/106204

PCT Pub. Date: Jun. 14, 2018

(65) Prior Publication Data

US 2019/0309496 A1 Oct. 10, 2019

(30) Foreign Application Priority Data

Dec. 7, 2016 (TR) ..... A 2016 18064

(51) Int. Cl.
*E02D 5/80* (2006.01)
*E02D 5/74* (2006.01)

(52) U.S. Cl.
CPC ..... *E02D 5/803* (2013.01); *E02D 5/74* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,187,858 | A * | 6/1965 | Des Champs | E02D 5/54 52/160 |
| 3,276,173 | A * | 10/1966 | Bowman | E02D 5/54 52/164 |
| 4,015,433 | A * | 4/1977 | Shibata | E02D 5/54 405/259.5 |
| 4,843,785 | A | 7/1989 | Sero | |
| 2003/0115810 | A1* | 6/2003 | Reinert, Sr. | E02D 5/803 52/156 |
| 2005/0117977 | A1 | 6/2005 | Rasumussen | |
| 2015/0252546 | A1* | 9/2015 | Berger | E02D 5/803 52/160 |
| 2017/0121927 | A1* | 5/2017 | Hoyt | E02D 5/803 |

FOREIGN PATENT DOCUMENTS

| | | |
|---|---|---|
| JP | 2002121735 | 4/2002 |

* cited by examiner

*Primary Examiner* — Kyle Armstrong
(74) *Attorney, Agent, or Firm* — Crose Law LLC; Bradley D. Crose

(57) ABSTRACT

The invention relates to a jet anchor which ensures the fixation of the lateral support elements on the surface to mass formed by high pressure jet injection with purpose of providing stabilization of the excavation surface during excavation support and slope stability works, said jet anchor provides the combined usage of anchor body (120), ducted cutting wing (140), connectors, rigid wing opening plate (130), rope pulling apparatus (110), guide pipe elements (150) with new anchor equipment and jet grouting system and thus obtaining strength increased anchor element.

5 Claims, 4 Drawing Sheets

HIGH STRENGTH JET ANCHOR

TECHNICAL FIELD THAT THE INVENTION RELATES

In the field of geotechnical engineering, the invention relates to jet anchor which ensures the fixation of the elements on the surface to mass formed by jet injection with purpose of providing stabilization of the excavation surface during excavation support and slope stability works.

In particular, the invention relates jet anchor that provides the combined usage of anchor body, ducted cutting wing, connectors, rigid wing opening plate, rope pulling apparatus, guide pipe elements with new anchor equipment and high pressure jet grouting system and thus obtaining strength increased anchor element.

STATE OF THE ART

The deep basic requirement of multi-storey buildings constructed within the scope of geotechnical department around the world and the increase in the underground structure constructions have increased the ground supporting works. In case the elements such as pile, pile-plank, retaining walls used as lateral support elements are inadequate, bearing capacities are increased by the anchorage. Anchor is a structural part that transmits tensile force applied thereon to the appropriate floor.

Anchor application; is based on the principle of increasing capacity and decreasing displacement of the lateral support members by the anchors with sufficient strength in the projects where the excavation support elements are insufficient in deep excavations. In conventional application; steel ropes are placed in the well after horizontal or angled drilling to the project depth is executed in the field. At the end section of the well, cement-water injection called blasting, is made and the root zone is formed. This injection is either done with low pressure around 5-10 bar or without pressure (by gravity). The root zone strength is determined by the friction resistance between this injection and the ground, and this design depending only on friction, necessitates the root zone to be very long. After the setting of injection, the rope is fixed to lateral beams by stretching at the exit of the well.

In the jet grouting method, which is used as a soil improvement method normally, the cement-water mixture is ejected into the floor through the nozzles at high pressure (350-500 bar). Therefore, the soil-concrete mixture constitutes composite structure.

After preliminary research about the state of the art, the patent document numbered "2006/06589" has been examined. In the summary part of the present invention, the following information can be found; "The anchor ropes passed through the hose are separated from each other on the centering side. Thus, they are prevented from being embrangled. The anchor is passed through an isolation plug which prevents the passage of cement injection into the empty area. Then the anchorage ropes are separated by means of a separator and a wellbore moderator and the injection process is performed homogeneously and the load carrying capacity is increased. The anchorage system is ensured to achieve the target by means of the anchor tip guide without any problems."

After preliminary research about the state of the art, the patent document numbered "US2005117977" has been examined. In the invention subjected to application, reinforcement application for the base element (tension reinforcement at sub-base course piles). The system that is subject of the invention does not include any injection or jet injection. For this reason, it doesn't constitute composite root zone.

After preliminary research about the state of the art, the patent document numbered "JP2002121735" has been examined. In the invention subjected to application, parachute for soft grounds is used as anchorage base element. The system of the invention does not include injection, opening-closing ring, locking detail, tensioning element and guide. As a result of the movement of the interwoven tubes, the wings are opened.

The typical anchorage method, which is used in the state of the art, result in time, cost and labor losses with the formation of very long root zone. Retaining walls collapse because of the reasons such as incorrect design, workmanship defects, inadequate injection, problems experienced during stretching, time-dependent corrosion and detachment effects in anchorages placed in soil which is in heterogeneous structure wherein there are many obscurities. Naturally, that causes serious loss of life and property. Particularly in the tunnel and mining structures observed, there is not much opportunity to rescue. Furthermore, the injection problem can be faced in the soils.

As a result, due to the above-mentioned problems and because of the inadequacy of the existing solutions, it has become necessary to make an improvement in the technical field.

AIM OF THE INVENTION

The most important object of the invention is to enable high efficiency utilization in projects that are exposed to overloads wherein piles, pile-plank, retaining walls are inadequate and even in cases where typical anchors cannot provide the desired performance.

Another object of the invention is to allow for safe use in projects which are exposed to overloads. By this measure, instead of the peel calculation which causes unexpected collapses, more reliable retaining walls are achieved by using the known strength calculations.

Another object of the invention is to provide a high strength composite structure by jet anchor which is designed as reinforcement with usage for root zone formation.

Another object of the invention is to remove the possibility of non-formation of concrete block in the rope end zone by applying high-pressure jet injection.

An object of the invention is that the most effective design can be made by the minimum number of anchor and the anchorage root zone length due to jet anchor usage. By this means, geotechnical structures that prioritize life safety can be built.

Structural and characteristic specifications and all advantages of the invention will be understood more clearly by means of figures given below, and detailed descriptions written by referencing to those figures. Therefore, assessment should be done by taking these figures and detailed description into consideration.

REFERENCE NUMBERS

Figure 1:
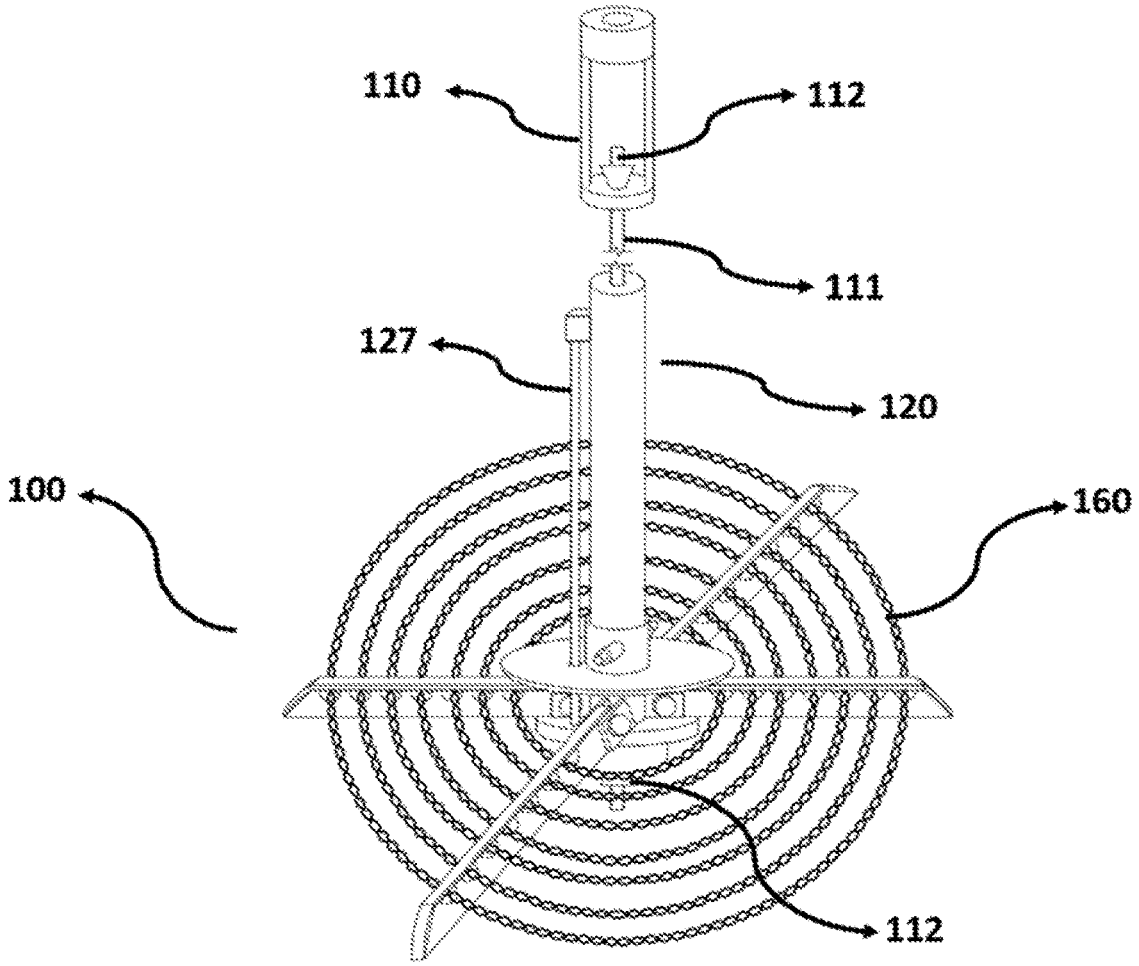
FIG. 1; is illustration showing the general perspective view of jet anchor that is subject of the invention.
Figure 2:
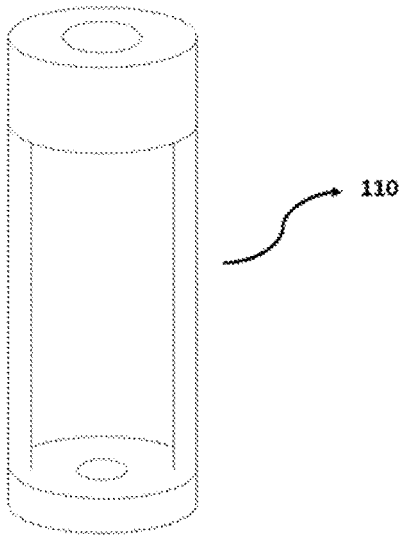
FIG. 2; is illustration showing the general perspective view of rope pulling apparatus of the jet anchor that is subject of the invention.
Figure 3:
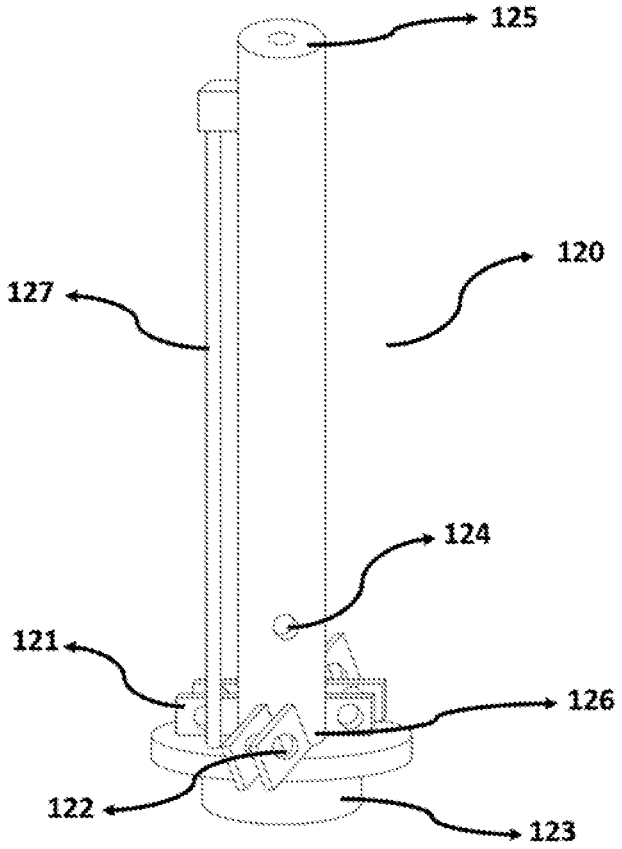
FIG. 3; is illustration showing the anchor body view of jet anchor that is subject of the invention.
Figure 4:
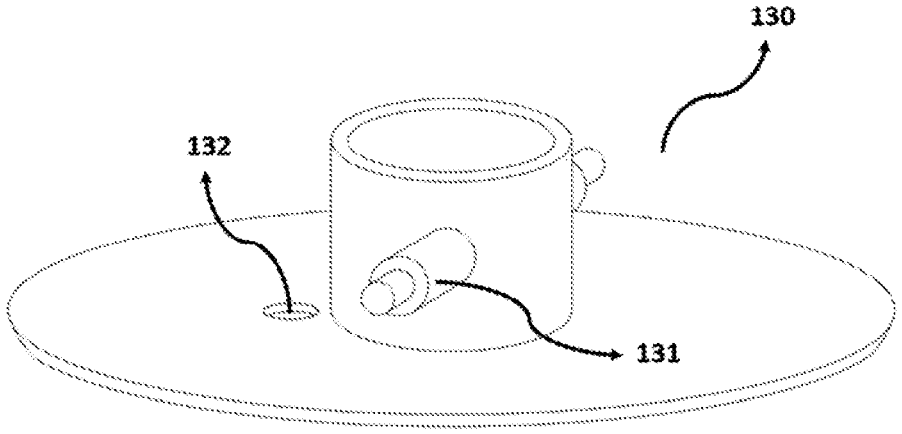
FIG. 4; is illustration showing the wing opening plate view of jet anchor that is subject of the invention.
Figure 5:
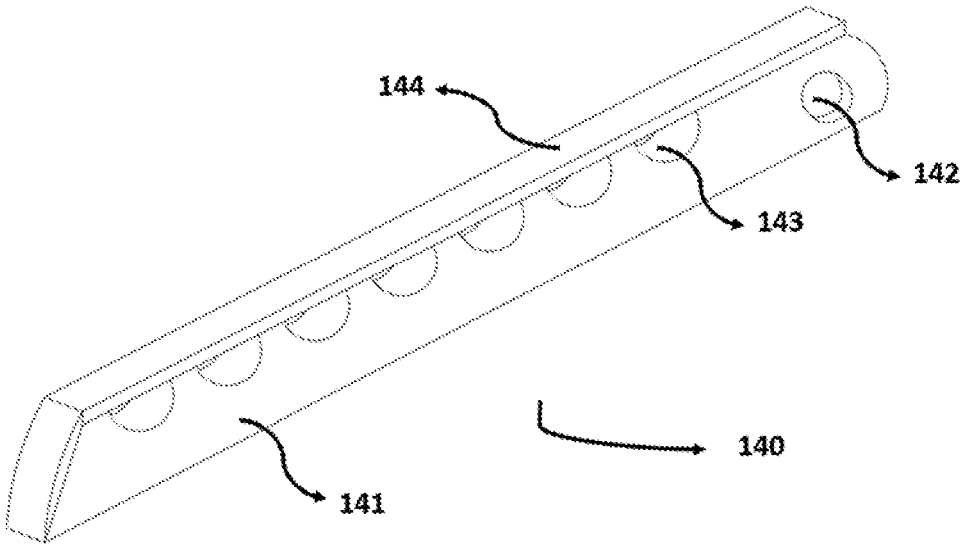
FIG. 5; is illustration showing the ducted cutting wings view of jet anchor that is subject of the invention.
Figure 6:
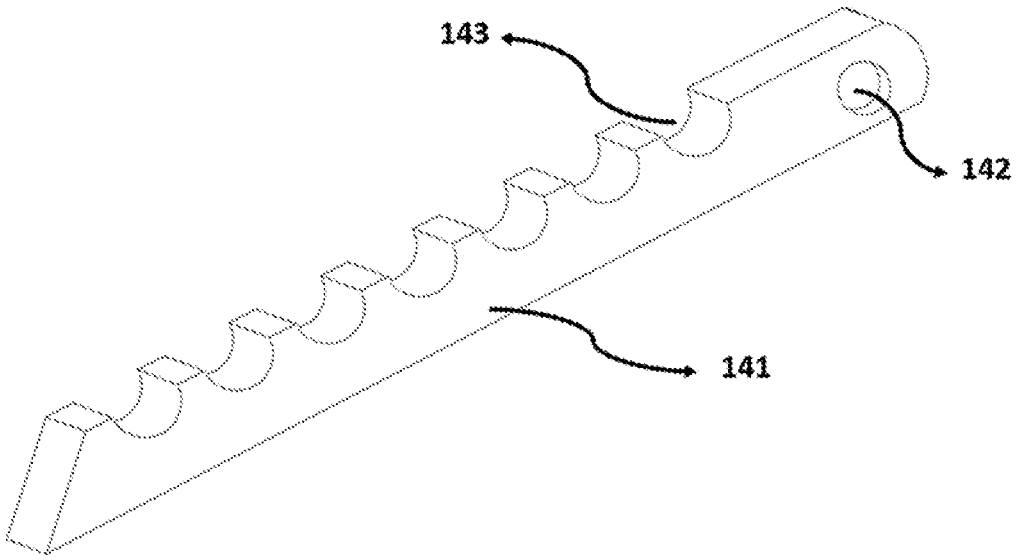
FIG. 6; is illustration showing sub-profile view of the ducted cutting wings of jet anchor that is subject of the invention.
Figure 7:
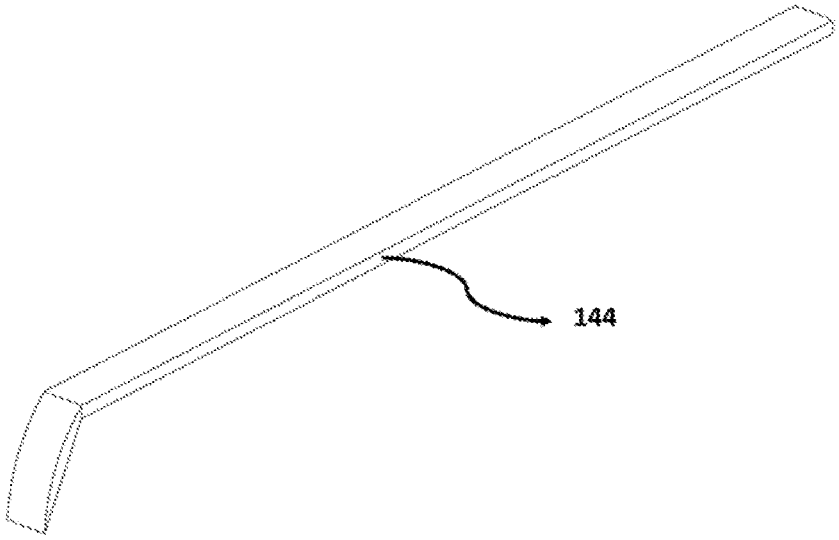
FIG. 7; is illustration showing top-profile view of the ducted cutting wings of jet anchor that is subject of the invention.
Figure 8:
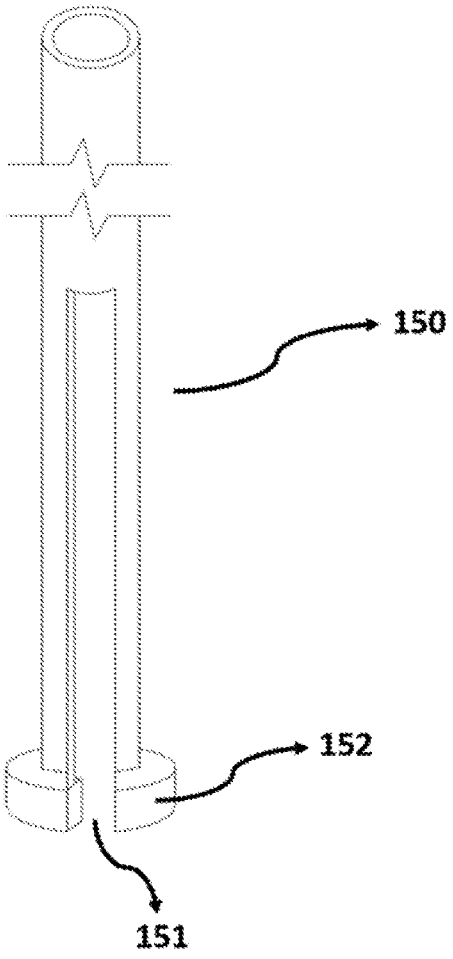
FIG. 8; is illustration showing the guide pipe element view of jet anchor that is subject of the invention.

100. Jet Anchor
110. Rope Pulling Apparatus
  111. Anchorage Rope
  112. Spline
120. Anchor Body
  121. Lug
  122. Lug Connection Housing
  123. Anchor Head
  124. Lock Housing
  125. Body Upper-Part
  126. Body Lower-Part
  127. Inner Guide Pipe
130. Wing Opening Plate
  131. Fixation Lock
  132. Inner Guide Hole
140. Ducted Cutting Wing
141. Lower Wing Profile
142. Upper Wing Profile
143. Chain Duct
144. Connection Housing
150. Guide Pipe
  151. Lock Gap
  152. Rigid Support Plate
160. Chain

DESCRIPTION OF THE INVENTION

The invention relates to jet anchor which is used for fixation of lateral support elements on surface to the mass formed by high pressure jet injection at 350-500 bar with the purpose of providing stabilization of the excavation surface during excavation support and slope stability works to be done, and which has rope pulling apparatus (110) and guide pipe (150) and comprises anchor body (120), wing opening plate (130), ducted cutting wings (140) and to operation method thereof.

Anchor body (120) contained by the jet anchor (100) that is subject of the invention is in a hollow tube form through which anchor rope (111) is able to pass, wherein it has lugs (121) connected with anchor body (120) at the body lower-part (126) and anchor head (123) located under the lugs (121) and functioning as bearing for the lugs (121).

There should be at least four ducted cutting wings (140) contained by the jet anchor (100) that is subject of the invention in order that the system stability is achieved and that the ducted cutting wings (140) can be opened simultaneously and wherein each of them is able to move from the parallel position with the anchor body (120) towards the vertical position with the anchor body (120). In cases where the strength is inadequate, more than four ducted cutting wings (140) can be utilized provided that they are produced with equal angles and ranges and/or the length can be extended considering ground conditions. Ducted cutting wings (140) comprise; at least one connection housing (144) to be assembled with the lugs (121) located on the anchor body (120) and lower wing profile (141) comprising chain duct (143) as many as the number of chains (160) to be used in the jet anchor (100) system and upper wing profile (142) covered on lower wing profile (141).

Wing opening plate (130) contained by the jet anchor (100) that is subject of the invention leads the ducted cutting wings (140) to move from the parallel position with anchor body (120) towards the vertical position with anchor body (120) by contacting the ducted cutting wings (140) during the usage of the jet anchor (100). Wing opening plate (130); comprises at least two mutually positioned fixation lock (131) that would function as locking such that they correspond to lock housing (124) located on anchor body (120) and positioned on the ducted cutting wings (140) which are connected with movable lugs (121) by being passed through the outer surface of the anchor body (120). The inner guide hole (132) located on the wing opening plate (131) so that the wing opening plate (130) can move in the center is passed through the inner guide pipe (127) on the anchor body (120) to provide appropriate movement.

The guide pipe (150) contained by the jet anchor (100) that is subject of the invention comprises; lock gap (151) in a hollow pipe form which is to be engaged on anchor body (120) and on wing opening plate (130) located thereon and where fixation locks (131) contained by wing opening plate (130) is to be placed in order that it fits fully on the wing opening plate (130), and rigid support plate (152) which contacts with wing opening plate (130) during operation at its end that contact with wing opening plate (130).

The rope pulling apparatus (110) of the jet anchor (100) that is subject of the invention; in the process of opening of the ducted cutting wings (140), ensures the ducted cutting wings (140) to open by applying a pulling force over the anchor rope (111) by operating in coordination with the guide pipe (150). The rope pulling apparatus (110) is produced by welding the two rigid circular plates together with the profiles after a distance for the length of the anchor rope (111) is left. An end of the rope pulling apparatus (110) is fixed to rod of drilling machine and the anchor rope (111) is fixed to the other end thereof by means of the spline (112). The other free end of the anchor rope (111) is passed through the anchor body (120) and fixed to the anchor head (123) by the spline (112).

The anchor body (120) is fixed to body lower part (126) of the hollow steel pipe through which anchor rope (111) is able to pass starting from the body upper part (125) by connecting wing opening plate (130) and also anchor head under this wing opening plate (130). Each ducted cutting wing (140) is mechanically assembled by matching lug connection housing (122) and connection housing (144) located on the ducted cutting wing (140) by entering between two lugs (121) located on body lower part (126). Depending on the length of the ducted cutting wings (140), the number of chain duct (143) is determined according to the designed endurance. After the chains (160) are passed through the chain ducts (143) of the ducted cutting wing (140), the upper wing profile (142) is mounted mechanically permanently on the lower wing profile (141) of ducted cutting wing (140) along the ducted cutting wing (140). The chains (160) used in the jet anchor (100) system serve as a uniform support member for the jet anchor (100). The chains (160) provide simultaneous opening of the ducted cutting wings (140), at the same time they remain in concrete and are used in forming a composite structure (reinforced concrete).

The section of the wing opening plate (130), which can move along the anchor body (120) and which contacts with the ducted cutting wings (140), is produced angularly. In order that the wing opening plate (130) is able move in the center, the inner guide hole (132) is passed through the inner guide pipe (127) placed on the anchor body (120). In the implementation process, the guide pipe (150) in the well starts to push the wing opening plate (130) by contacting the rigid wing opening plate (130). When the wing opening plate (130) contacts the ducted cutting wings (140), starts to open the ducted cutting wings (140). When the fixation locks (131) located on wing opening plate (130) are in suitable position on anchor body (120), they enter into lock housing (124) placed on anchor body (120) and springs located in the fixation locks (131) are released and as a result of completely opening of ducted cutting wings (140) ensures it to remain fixed like this.

In the jet anchor (100) of the present invention, at least four pieces of ducted cutting wings (140) with a ducted structure and made of steel are used. In cases where the strength is inadequate, the number of the ducted cutting wings (140) can be increased as desired, also taking the diameter of the anchor body (120) into account, provided that they are placed with equal angles on the anchor body (120).

The anchor body (120) is manufactured from steel or other metal materials with sufficient strength.

In the process of lowering the jet anchor (100) onto the ground, the guide pipe (150) manufactured from hollow metal pipe with sufficient strength is lowered to well after the jet anchor (100) is lowered to the well. The guide pipe (150) is provided with a lock gap (151) in the form of a slit to enable the wing opening plate (130) to be fully seated. The rigid support plate (152) of the guide pipe (150) is connected to the wing opening plate (130) to prevent buckling and bending of the metal. The guide pipe (150) applies pushing force on the wing opening plate (130) enabling the opening of the ducted cutting wings (140) by operating in coordination with rope pulling apparatus (110) both after the jet anchor (100) is centered to the well and after contacting to wing opening plate (130).

In High Strength Jet Anchor (100) system, jet injection is applied first, then high strength jet anchor (100) equipment is lowered to the well and is opened when the concrete is fresh.

The jet grouting system, which is used only for soil improvement purposes in the geotechnical engineering, is used as a new anchorage equipment and method by the jet anchor (100) that is subject of the invention, and its application method.

The following method is applied to implement the jet anchor (100) to the ground;

Opening of the drill hole to the required depth,

Adequate amount of high pressure jet injection,

Obtaining a composite structure by ensuring the ducted cutting wings (140), the chain (160) and the anchor body (120) sections of the jet anchor (100) to stay in the concrete by lowering the jet anchor (100) to the well before the concrete starts to take setting, Lowering the guide pipe (150) to the well, Fixing of the anchor ropes (111) that are outside the well to the rope pulling apparatus (110), Fixing the rope pulling apparatus (110) to rod of the drilling machine or to an external tower, Pulling of the anchor rope (111) and enabling the guide pipe (150) to be in contact with the ducted cutting wings (140) by pushing the wing opening plate (130) having a rigid structure, The opening of the ducted cutting wings 140 from the lower side by way of the wing opening plate (130) when the anchor rope (111) is pulled out, Fixing the fixation locks (131) on the wing opening plate (130) to the lock housings (124), Completely opening of the ducted cutting wings (140) in the concrete by the fixing of the fixation locks (131) and thus preventing them to close back, Demounting of the rope pulling apparatus (110) and removal of the guide pipe (150), Waiting for the concrete setting, Fixing the jet anchor (100) to lateral beams on the well surface by pulling in the project load.

High efficiency utilization in projects that are exposed to overloads wherein piles, pile-plank, retaining walls are inadequate and even in cases where typical anchors cannot provide the desired performance, is allowed by the jet anchor that is subject of the invention and its application method.

The invention claimed is:

1. A jet anchor (100) for fixing lateral support elements to a formed mass by jet injection with purpose of providing stabilization of an excavation surface (ground surface) during excavation support and slope stability works to be performed, characterized in that it comprises;

a rope pulling apparatus (110) an end of which is fixed to rod of a drilling machine and which is fixed by an anchor spline (112) by transferring an anchor rope (111) from other end, and which allows ducted cutting wings (140) to open by applying a pulling force over the anchor rope (111) by operating in coordination with a guide pipe (150), an anchor body (120) that is in a hollow tube form through which the anchor rope (111) is able to pass, wherein it has lugs (121) connected with the anchor body (120) at a body lower-part (126) and an anchor head (123) located under the lugs (121) and functioning as bearing for the lugs (121), and has an inner guide pipe (127) that allows a wing opening plate (130) to move in the center, the wing opening plate (130) comprising at least two mutually positioned fixation locks (131) that would function as locking such that they correspond to lock a housing (124) located on the anchor body (120) and positioned on ducted cutting wings (140) which are connected with the movable lugs (121) by being passed through outer surface of the anchor body (120), the ducted cutting wings (140) which are able to move from parallel position with the anchor body (120) towards vertical position with the anchor body (120), and comprise at least one connection housing (144) to be assembled with the lugs (121) located on the anchor body (120) and a lower wing profile (141) comprising chain ducts (143) as many as the number of chains (160) to be used in the jet anchor (100) system and an upper wing profile (142) covered on the lower wing profile (141), the guide pipe (150) comprising a lock gap (151) in a hollow pipe form which is to be engaged on the anchor body (120) and on the wing opening plate (130) located thereon and where the fixation locks (131) contained by the wing opening plate (130) is to be placed in order that it fits fully on the wing opening plate (130), and a rigid support plate (152) which contacts with the wing opening plate (130) during operation at its end that contact with the wing opening plate (130).

2. The jet anchor (100) for fixing lateral support elements to the formed mass with purpose of providing stabilization of the excavation surface during excavation support and slope stability works to be performed which are mentioned in claim 1, wherein each of the ducted cutting wings (140) of it, is able to move from the parallel position with the anchor body (120) towards the vertical position with the anchor body (120) and they consist of four pieces which can be opened simultaneously.

3. The jet anchor (100) for fixing lateral support elements to the formed mass with purpose of providing stabilization of the excavation surface during excavation support and slope stability works to be performed which are mentioned in claim 1, wherein it comprises chains (160) which are uniform support element for the jet anchor (100) and provide simultaneous opening of the ducted cutting wings (140), at the same time remain in concrete and are used in forming a composite structure.

4. The jet anchor (100) for fixing lateral support elements to the formed mass with purpose of providing stabilization of the excavation surface during excavation support and slope stability works to be performed which are mentioned in claim 1, wherein the ducted cutting wings (140) of it are manufactured from steel.

5. An application method of jet anchor (100) for fixing lateral support elements to the mass formed by high pressure jet injection at 350-500 bar with purpose of providing stabilization of the excavation surface during excavation support and slope stability works to be performed according to claim 1, wherein it comprises the following process steps;

opening a drill hole to required depth, adequate amount of high pressure jet injection, obtaining a composite structure by ensuring the ducted cutting wings (140), the chain (160) and the anchor body (120) sections of the jet anchor (100) to stay in the concrete by lowering the jet anchor (100) to well before the concrete starts to set, lowering the guide pipe (150) to the well, fixing of the anchor ropes (111) that are outside the well to the rope pulling apparatus (110), fixing the rope pulling apparatus (110) to rod of the drilling machine or to an external tower, pulling up the anchor rope (111) and enabling the guide pipe (150) to be in contact with the ducted cutting wings (140) by pushing the wing opening plate (130) having a rigid structure, the opening of the ducted cutting wings 140 from the lower side by way of the wing opening plate (130) when the anchor rope (111) is pulled up, fixing the fixation locks (131) on the wing opening plate (130) to the lock housings (124), completely opening the ducted cutting wings (140) in the concrete by the fixing of the fixation locks (131) and thus preventing them to close back, demounting of the rope pulling apparatus (110) and removal of the guide pipe (150), waiting for the concrete to set, fixing the jet anchor (100) to lateral beams on the well surface.

* * * * *